US006447289B1

(12) United States Patent
Boyne et al.

(10) Patent No.: US 6,447,289 B1
(45) Date of Patent: Sep. 10, 2002

(54) ROTARY DRUM ROLLER SUPPORT ADJUSTABLE ON A SKEW AXIS

(76) Inventors: Jeffery Franklin Boyne, 16222-10A Avenue, White Rock, British Columbia (CA), V4A 8A9; Donavan Roy Larsen, 34640 Currie Place, Abbotsford, British Columbia (CA), V2S 7J1

( * ) Notice: Subject to any disclaimer, the term of this patent is extended or adjusted under 35 U.S.C. 154(b) by 0 days.

(21) Appl. No.: 09/891,537

(22) Filed: Jun. 27, 2001

(51) Int. Cl.[7] ..... F27B 7/20
(52) U.S. Cl. ..... 432/118; 432/103; 432/160
(58) Field of Search ..... 432/103, 110, 432/118, 124, 160; 384/549; 34/200

(56) References Cited

U.S. PATENT DOCUMENTS 3,648,992 A * 3/1972 Durinck et al. ..... 384/549
3,711,075 A * 1/1973 Raevsky et al. ..... 263/33 R
4,160,569 A * 7/1979 Reid ..... 384/549
4,171,949 A * 10/1979 Endersen et al. ..... 432/103
4,344,596 A * 8/1982 Hjaeresen ..... 432/103

* cited by examiner

*Primary Examiner*—Gregory Wilson
(74) *Attorney, Agent, or Firm*—Lance A. Turlock

(57) ABSTRACT

A support stand for supporting an elongated rotary drum for rotation about a longitudinally extending drum axis includes a lower portion extending upwardly from a base to a tilted top extending in a plane of tilt; a correspondingly tilted upper portion mounted atop the lower portion, and a carrying roller rotatably mounted on the upper portion for rotation about a roller axis while a riding ring extending coaxially around the drum bears against and rides in rolling contact on the roller. The upper portion is rotatably positionable relative to the lower portion about a skew axis perpendicularly intersecting the plane of tilt at a fixed point. The skew axis substantially radially intersect the drum axis. As well, the skew axis substantially radially intersects the roller axis. A mechanism for adjusting the amount of skew and an indicator for displaying the amount of skew are also disclosed. Further, rotary drum supported by a plurality of such stands and a method of aligning the stands with respect to the drum is also disclosed.

18 Claims, 8 Drawing Sheets

ROTARY DRUM ROLLER SUPPORT ADJUSTABLE ON A SKEW AXIS

BACKGROUND TO THE INVENTION

The present invention relates to roller supported rotary drums of the type used for agitating, mixing, heating and/or otherwise handling material (for example, particulate matter). More particularly, the present invention relates to rotary drums having riding rings that are supported on carrying rollers for rotation on a drum axis diverging slightly from a horizontal axis, and which typically require the rollers to be skewed with respect to the riding rings.

The prior art is replete with designs for stands having carrying rollers used to carry rotary drums during rotation about a drum axis that slopes slightly from the horizontal. The slope is necessary to ensure that material being handled by the drum properly travels lengthwise within the drum during the handling process. Typically, a drum will include riding rings extending coaxially around the drum for receiving the required support from the carrying rollers. However, by reason of the slope and the force of gravity, special measures have to be taken to confine axial movement of the drum. Unless restrained, the natural tendency of the drum will be to move axially downhill as the drum rotates.

The primary mechanisms for confining axial movement of a drum are thrust rollers. They act on the riding rings and assist to maintain the rings in a centered position on the carrying rollers. However, they are often not designed to resist the full thrust that a rotary drum and its load may impart—at least not for any significant period of time. To address this limitation, it is commonplace to skew a drum's carrying rollers in relation to the riding rings in a manner that urges the drum axially uphill as the drum rotates; in effect counteracting the force of gravity. The skew takes place about a skew axis, viz. the axis on a line drawn from the center of rotation of a roller and radially intersecting the drum axis. However, if the skewing is insufficient, a thrust roller may still encounter significant force leading to premature failure. Conversely, if the skewing is excessive, then excessive wear and tear may take place on the riding ring and the carrying roller.

Various mechanisms have been devised for supporting carrying rollers and for adjusting the skew of carrying rollers relative to riding rings. However, they are often quite complex. As well, in the case of many designs, the adjustment of a roller's skew actually requires a series of adjustment steps; for example, first moving one side of a roller's support (e.g. to draw it forwardly by a small amount), then moving the other side of the roller's support (e.g. to push it backwardly by a small amount), then having to repeat such steps until a desired degree of skew rotation has been achieved. The problem is that translational as well as rotational movement may occur unless such adjustments are made with extreme care and precision. With repeated adjustments, serious misalignments with other rollers that should be similarly adjusted can gradually develop. The costly process of realigning an entire installation may then become necessary.

A primary object of the present invention is to provide a new and improved support stand for a rotary drum, the stand including a carrying roller that can be precisely skewed with respect to a riding ring of the drum without allowing translational movement.

A further object of the present invention is provide in association with such a support stand, an adjustment mechanism that permits desired skew adjustments to be easily made.

Yet another object of the present invention is to provide in association with such a support stand a means for easily discerning the amount of skew.

A still further object of the present invention is to provide a rotary drum supported by such support stands, and a method for aligning the stands with respect to the drum.

SUMMARY OF THE INVENTION

In a broad aspect of the present invention, there is provided a support stand for supporting an elongated rotary drum for rotation about a longitudinally extending drum axis, the drum including a riding ring extending coaxially around the drum for receiving such support. The stand includes a lower portion extending upwardly from a base to a tilted top which extends in a predefined plane of tilt. A correspondingly tilted upper portion is rotatably mounted atop the lower portion, and is rotatably positionable relative to the lower portion about a skew axis perpendicularly intersecting the predefined plane of tilt at a fixed point. A carrying roller is rotatably mounted on the upper portion for rotation about a roller axis while the ring bears against and rides in rolling contact on the roller with the skew axis substantially radially intersecting the drum axis. As well, the skew axis substantially radially intersects the roller axis.

In a preferred embodiment, the upper portion of the stand is constrained to rotate relative to the lower portion about the skew axis by a center pin extending from the lower portion to the upper portion. The center pin has a center pin axis coinciding with the skew axis. By definition, this arrangement dictates that the skew axis intersects the plane of tilt at a fixed point, that point being the point where the center pin axis likewise intersects the plane of tilt.

Adjustment to a desired position of rotation may be achieved in various ways. An adjustment mechanism that is both rugged and simple comprises a resistance block mounted to the lower portion of the stand and an opposed pair of adjustment bolts, each bolt being threadingly engaged with an associated support bracket mounted to the upper portion of the stand. The bolts are aligned on a common axis that extends tangentially in relation to the skew axis, and the resistance block extends upwardly between the bolts. Each bolt is screwable within its support bracket to bear against the resistance block and thereby urge rotation of the upper portion of the stand relative to the lower portion of the stand about the skew axis. When a desired position of adjustment has been achieved, it may be secured in various ways such as with locking bolts.

In a preferred embodiment, the support stand includes an associated indicator for displaying the amount of rotation about the skew axis of the upper portion of the stand relative to the lower portion of the stand. This amount may be indicated in degrees, minutes, millimeters, or other units of measurement. The particular units of measurement are not critical. Those skilled in the art will understand that a suitable indicator may take various forms ranging from purely mechanical arrangements to electronic or electro-optical position sensing devices coupled to analog or digital readouts. In a preferred embodiment the indicator is a mechanically rugged arrangement comprising a measuring scale visibly marked on one portion of the stand and a pointer directed to the scale from the other portion of the stand. As the upper portion of the stand rotates relative to the lower portion about the skew axis, the pointer moves relative to the scale and the amount of rotation thus can be seen.

Advantageously, first and second pairs of such stands may be used in combination with a rotary drum of the foregoing type, the drum including first and second longitudinally spaced riding rings extending coaxially around the drum. The first pair of stands is associated with the first riding ring and provides support to the drum from opposed sides of the first riding ring. Similarly, the second pair of stands is associated with the second riding ring and provides support to the drum from opposed sides of the second riding ring. Each of the stands has upper and lower portions and a carrying roller as described above, and preferably each includes an indicator as described above for displaying the amount of its rotation about its skew axis. The riding ring associated with each stand bears against and rides in rolling contact on the stand's roller, the skew axis of the stand substantially radially intersecting both the roller axis and said drum axis.

In another aspect of the present invention, there is provided a method of providing roller support for an elongated rotary drum rotatable about a longitudinally extending drum axis, the drum including first and second longitudinally spaced riding rings extending coaxially around the drum, the method comprising:

(a) for each riding ring, providing a pair of stands for supporting the drum from opposed sides of the ring, each of the stands comprising:
  (i) a lower portion extending upwardly from a base to a tilted top lying in a plane of tilt;
  (ii) a correspondingly tilted upper portion rotatably mounted atop the lower portion, the upper portion being rotatably positionable relative to the lower portion about a skew axis perpendicularly intersecting the plane of tilt at a fixed point;
  (iii) a carrying roller rotatably mounted on said upper portion for rotation about a roller axis, the riding ring associated with the stand bearing against and riding in rolling contact on the roller, the skew axis substantially radially intersecting both the roller axis and the drum axis; and,
  (iv) an indicator for indicating the amount of rotation of the upper portion of the stand relative to the lower portion of the stand about the skew axis from an initial datum, (b) rotating the upper portion of each of the stands about its associated skew axis to a position such that the indicated amount of rotation relative to its lower portion is the same as for all stands.

Normally, the initial datum for a stand will correspond to zero degrees of relative rotation between the upper portion of the stand and the lower portion of the stand. When all four stands are at their initial datum and initially aligned with the drum, then the rollers will be fully squared (viz. in full face contact) with the riding rings. Typically, it is contemplated that such an initial alignment will be performed as a preliminary step on a new installation or, if significant wear and tear has occurred, as an initial step in the process of refurbishing or realigning an old installation. In a preferred embodiment, initial alignment comprises the step of aligning the stands with the drum such that:

(a) the fixed point of intersection between the skew axis and the plane of tilt of the stands define the corners of a rectangle;

(b) the roller axis of a first one of the rollers is axially aligned with the roller axis of a second one of the rollers, and extends parallel to the drum axis; and, (c) the roller axis of a third one of the rollers is axially aligned with the roller axis of a fourth one of the rollers, and extends parallel to the drum axis.

However, for reasons well understood by those skilled in the art, it often will be necessary for the drum axis of a rotary drum to diverge by a few degrees from true horizontal, the amount of divergence depending on the particular task at hand. It is then unsatisfactory for the rollers to be fully squared with the riding rings. There should be a suitable degree of skew. The present invention is particularly well adapted to enable desirable suitable skew adjustments to be made easily made without otherwise placing stands out of their initial alignment with a drum.

The foregoing and other features and advantages of the present invention will now be described with reference to the drawings.

DETAILED DESCRIPTION

Figure 1:
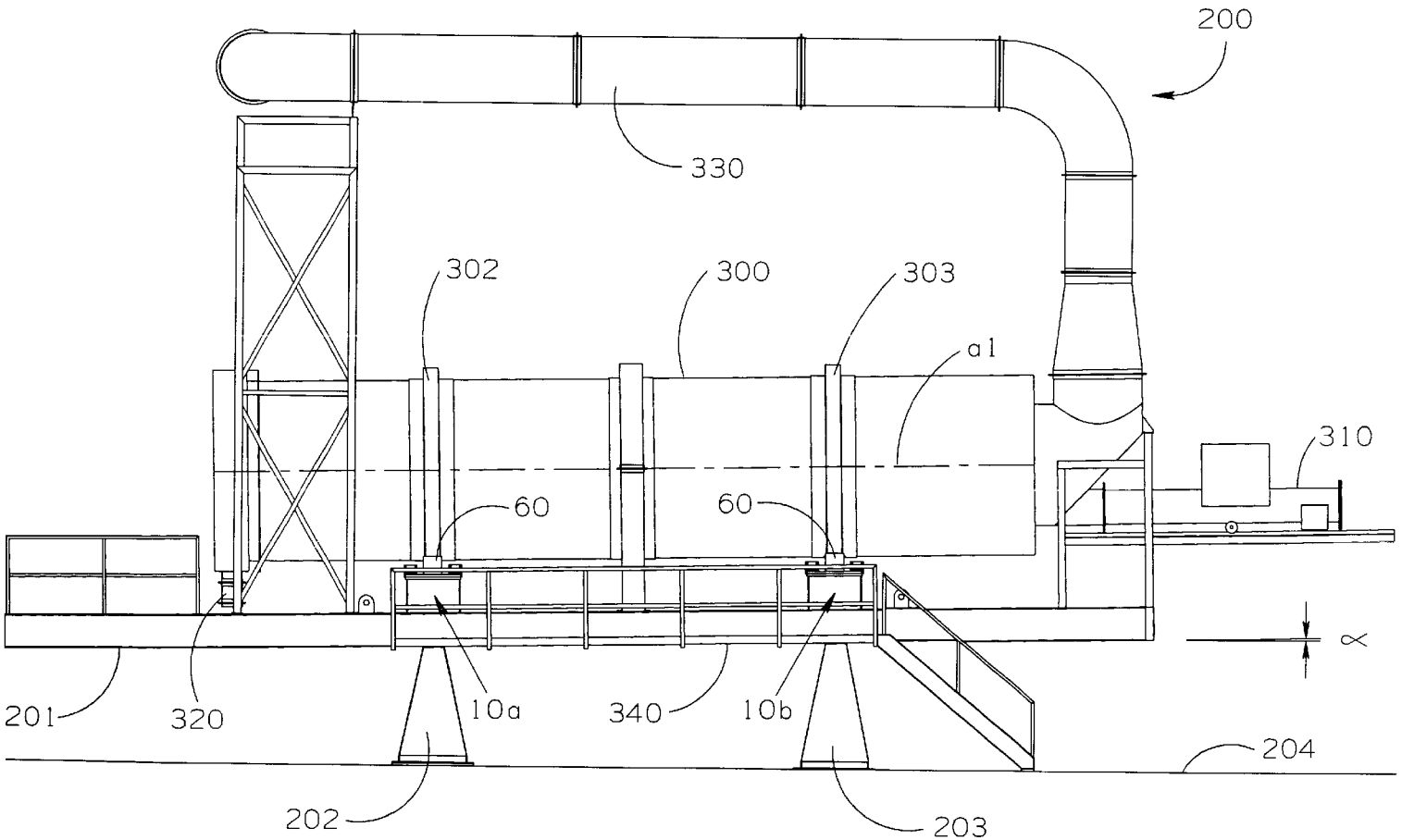
FIG. 1 is a representational side elevation view of an aggregate treatment plant incorporating a rotary drum supported by support stands in accordance with the present invention.

The aggregate treatment plant generally designated 200 in FIG. 1 represents one example of a practical use for the present invention. It is an example where moisture laden material such as damp or wet sand is fed to a rotary drum for moisture removal and ultimately discharged from the drum in a dried condition.

The plant includes a generally rectangular frame 201 mounted atop piers 202, 203. Pier 203 is slightly higher than pier 202. Hence, frame 201 is sloped at a small angle $\alpha$ with respect to horizontal ground 204. Plant 200 further includes a conventional elongated rotary drum 300 which is driven by conventional means (not shown) to rotate about drum axis a1. The drum is longitudinally aligned with the frame. Hence, like the frame, axis a1 is sloped at a small angle $\alpha$ with respect to ground 204. In operation, drum 300 receives aggregate material through a conventional auger feed 310 and discharges the treated material through a conventional outlet 320. Hot air is introduced to the drum through conventional ducting 330 from a hot air source (not shown).

Drum 300 includes conventional first and second longitudinally spaced riding rings 302, 303 extending coaxially around the drum. Four substantially identical support stands generally designated 10*a*, 10*b*, 10*c*, 10*d* (stands 10*c*, 10*d* being hidden from view in FIG. 1 but visible in FIG. 2) are mounted atop frame 201 and work in pairs to support drum 300 for rotation about drum axis a1, each on a carrying roller 60. As indicated in FIG. 1, stands 10*a*, 10*b* are accessible by workers along a railed walkway 340. A similar walkway (not shown) is provided on the opposite side of plant 200 for access to stands 10*c*, 10*d*.

Figure 2:
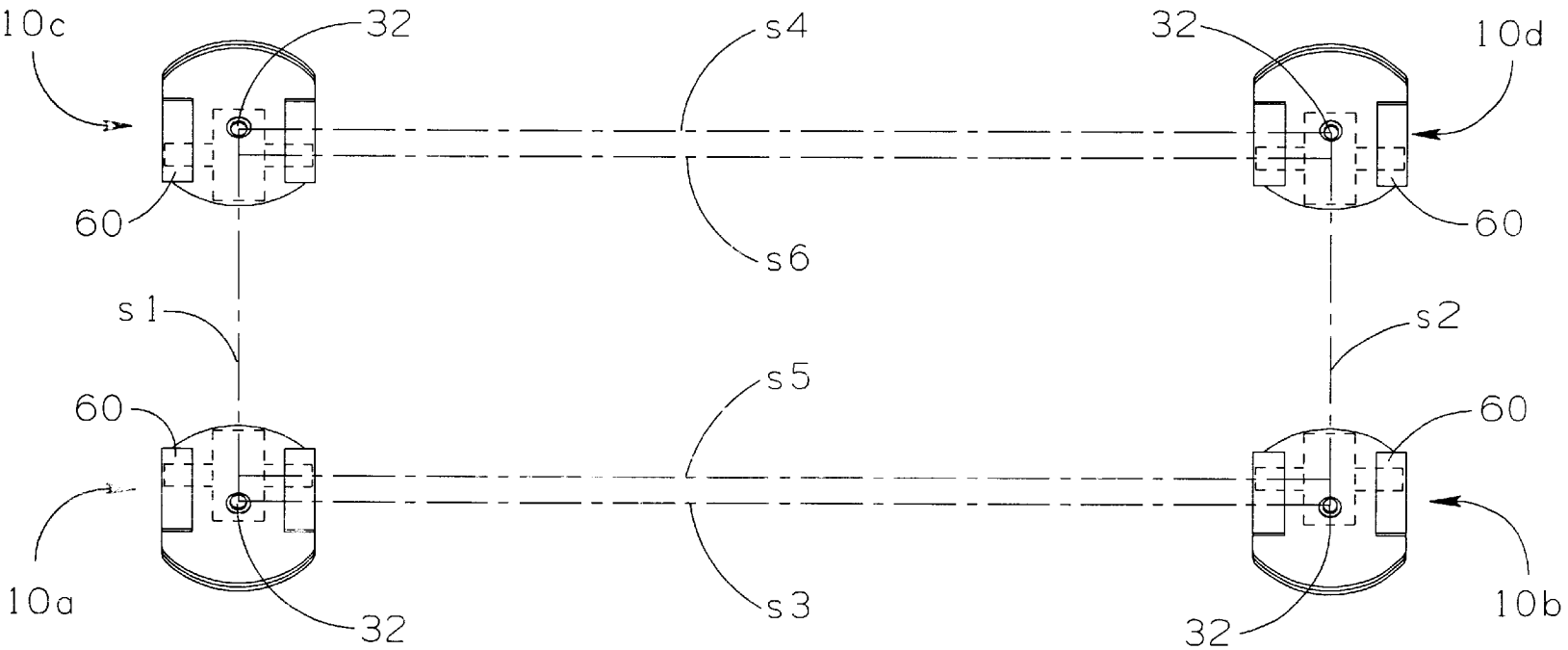
FIG. 2 is a top view illustrating the positions and initial orientations of four support stands in accordance with the present invention, when used in a plant such as that shown in FIG. 1. The bases of the stands all lie in the same plane, and the view is taken in a plane parallel to the base plane.
Figure 3:
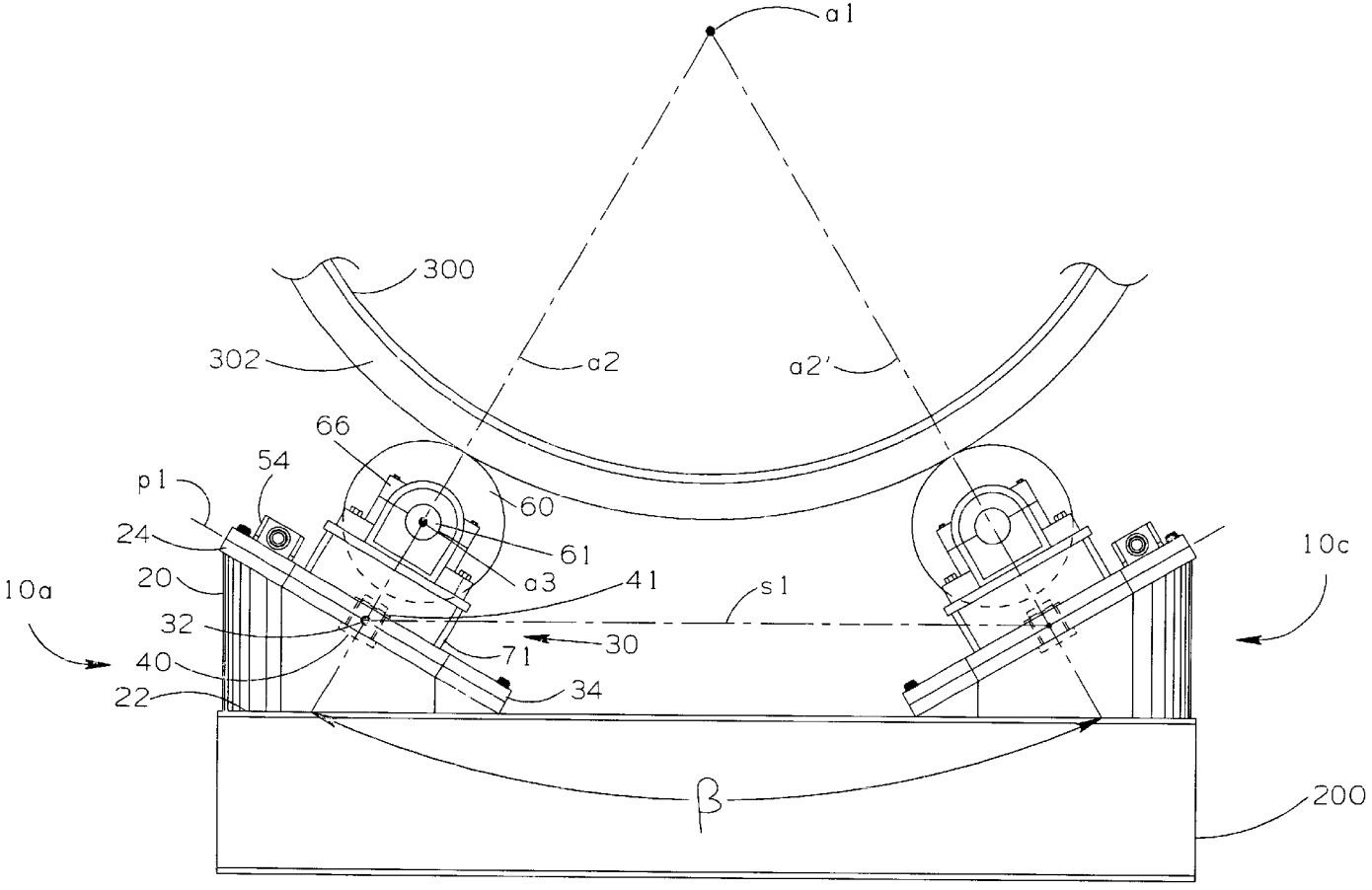
FIG. 3 is a detail view, partially cut-away, taken in a plane perpendicular to the drum axis in FIG. 1, and just before one the support stands shown in FIG. 1.

As best seen in FIG. 3, stands 10*a*, 10*c* work as a pair to provide support to drum 300 from opposed sides of riding ring 302. Although not shown in the same detail as stands 10*a*, 10*c* in FIG. 3, stands 10*b*, 10*d* (shown generally in FIG. 2) work similarly as a pair to provide support to drum 300 from opposed sides of riding ring 303.

Details of Stand Construction

Figure 4:
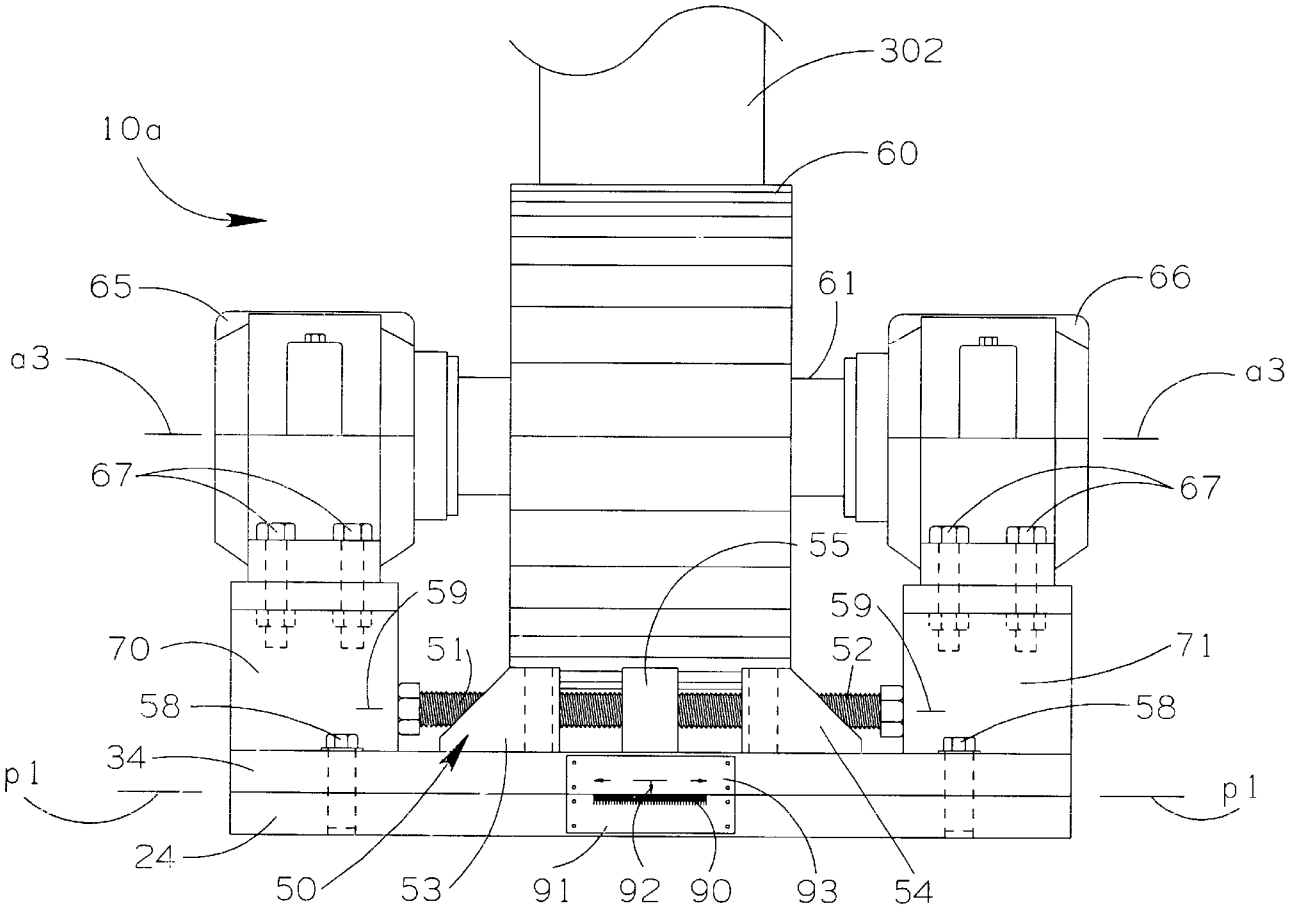
FIG. 4 is a front elevation view of a part of a support stand in accordance with the present invention, the view being taken in a plane perpendicular to the plane of tilt of the stand.
Figure 5:
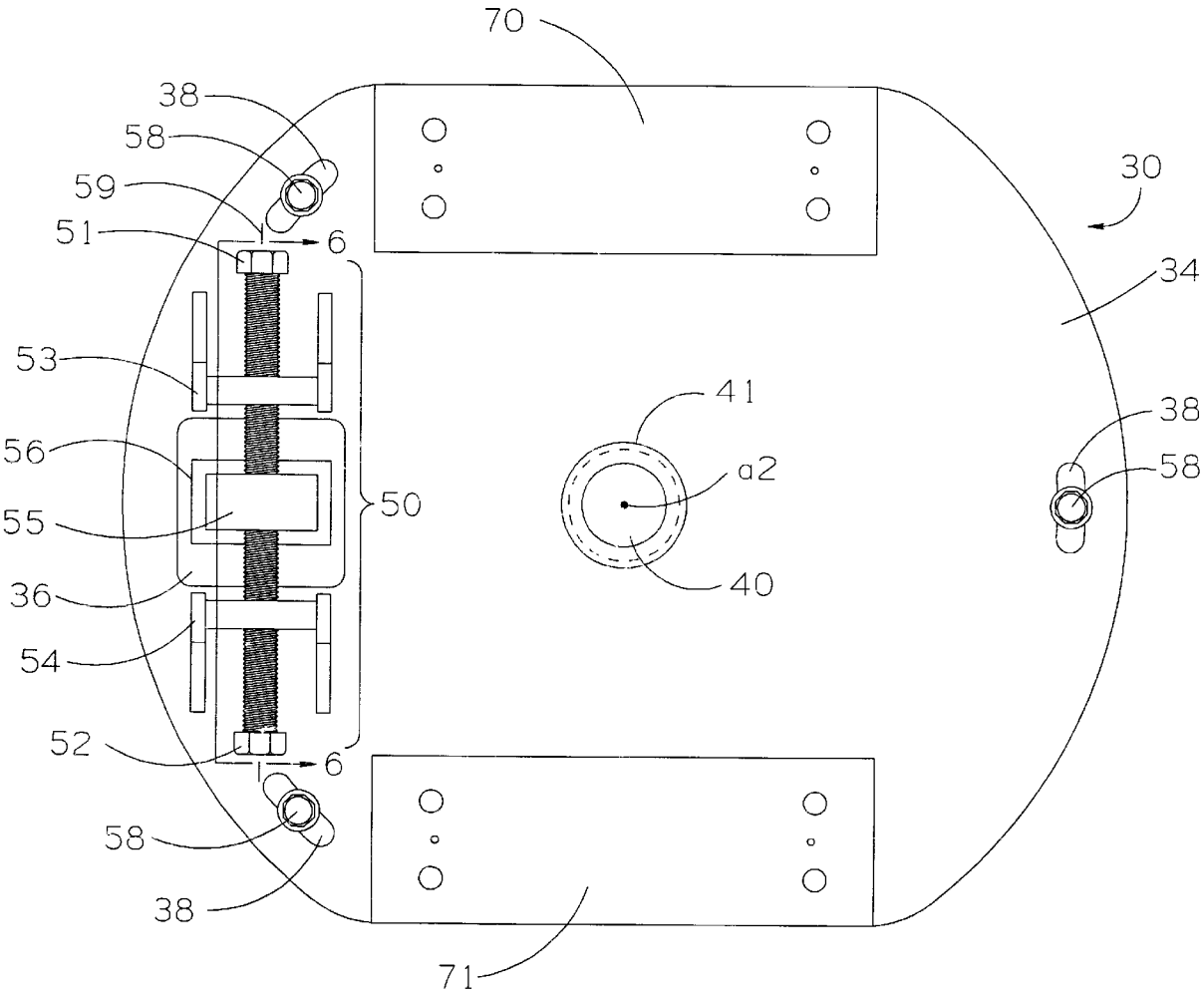
FIG. 5 is a top view of the stand shown in FIG. 4, the roller, roller shaft and pillow blocks that appear in FIG. 4 having been removed for the purpose of illustration.

For the purpose of discussion, the following description will be largely focused on stand 10*a* as depicted in FIGS. 3–5. However, apart the fixed positioning of stands 10*a*, 10*b*, 10*c* and 10*d* in relation to each other on frame 201, it will be understood that the description of stand 10*a* will apply in generally the same manner to any one of the stands.

Stand 10*a* comprises a lower portion 20 extending upwardly from a base 22 to a tilted top (plate 24) which extends in a plane of tilt p1. A correspondingly tilted upper portion generally designated 30 is mounted atop lower portion 20. Upper portion 30 is rotatably positionable relative to lower portion 20 about a skew axis a2 perpendicularly intersecting the plane of tilt p1 at an fixed point 32.

In more detail, base 22 of lower portion 20 is secured by welding to frame 201. Upper portion 30 comprises a lower plate 34 which flatly abuts plate 24 of lower portion 20, a roller 60 carried on roller shaft 61, and a pair of conventional pillow blocks 65, 66 within which shaft 61 is journalled. Each pillow block is secured through its base by mounting bolts 67 to an associated support stand 70, 71. Support stands 70, 71 are welded to the upper surface of lower plate 34. Roller 60 together with its shaft 61 is rotatable on roller axis a3. The abutment interface between plates 24, 34 includes a layer of grease or other suitable lubricant to minimize friction between the abutting surfaces.

Upper portion 30 is constrained to rotate relative to lower portion 20 about skew axis a2 by a center pin 40 extending from lower portion 20 to upper portion 30. Center pin 40 is secured in position by a snap ring 41, the axis of the center pin coinciding with skew axis a2. Fixed point 32 referenced above is necessarily on axis a2 midway along the center pin in plane p1.

In the position shown in FIG. 3, both roller axis a3 and drum axis a1 show as points. Thus the two axes are in parallel and there is zero degrees of relative rotation about skew axis a2 between the upper and lower portions 20, 30 of stand 10*a*. In effect, roller 60 has no skew in below, this is not a normal operating position. However, it is a useful starting point when a stand is being aligned for normal operations.

Figure 7A:
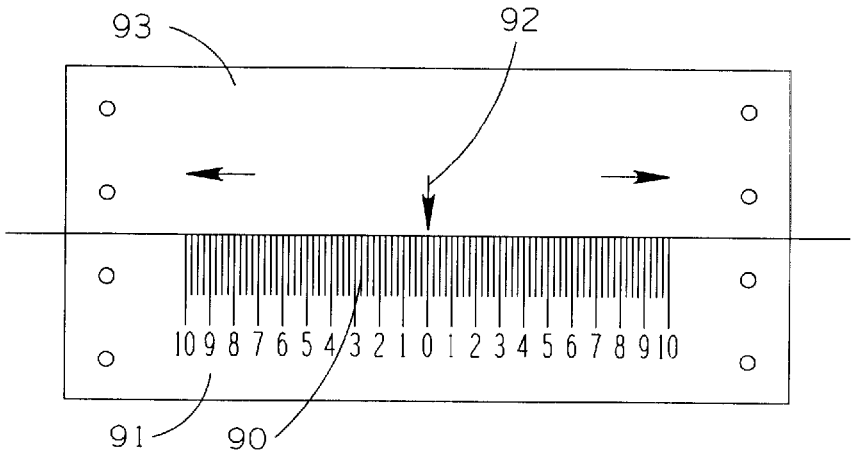
FIGS. 7A to 7C illustrate an indicator for displaying the amount of rotation of the upper portion of the support stand shown in FIG. 4 relative to the lower portion of the support stand.
Figure 7B:
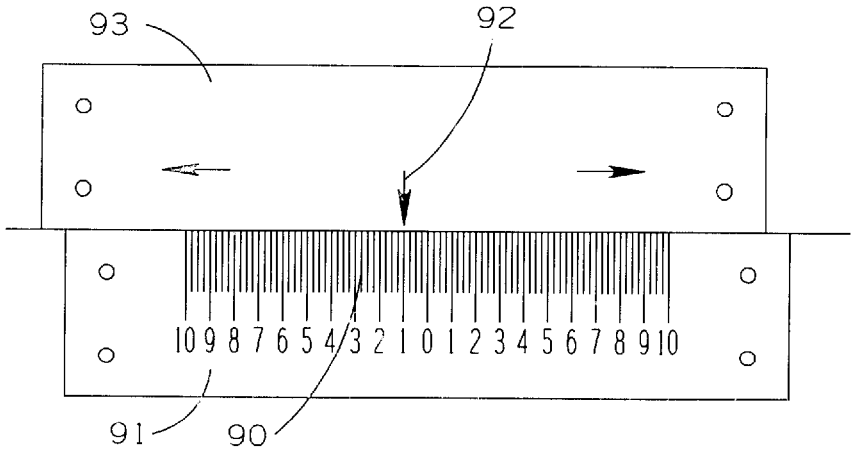
Figure 7C:
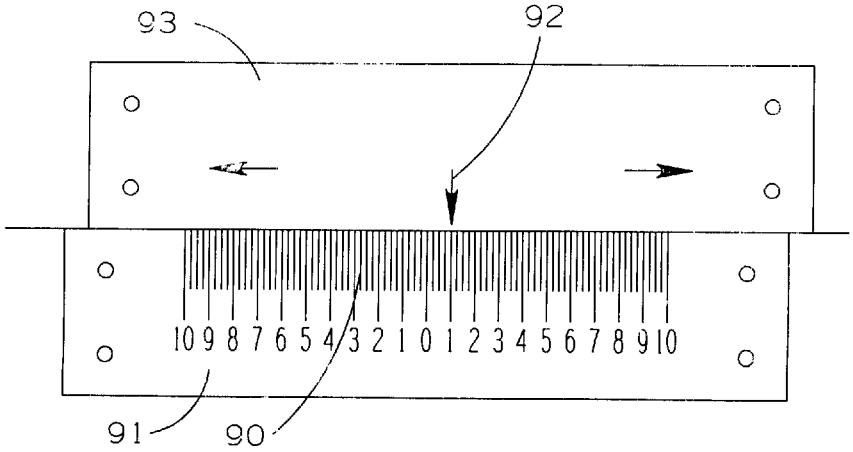

As shown in FIG. 4, but better seen in FIGS. 7A to 7C, the amount of rotation about skew axis a2 is displayed by an indicator comprising a measuring scale 90 marked on a thin plate 91 (viz. like a nameplate) secured to the outer perimeter of plate 24, and a pointer 92 directed to the scale—the pointer being visibly marked on a thin plate 93 (again like a nameplate) secured to the outer perimeter of plate 30. Scale 90 includes a center or "0" marking for indicating zero degrees or no relative amount of rotation between the upper and lower portions of stand 10*a* about skew axis a2 (see FIG. 7A), a first series of markings on one side of the "0" marking for indicating a progressive amount of rotation in one direction (e.g. clockwise rotation—see FIG. 7B) about skew axis a2, and a second series of markings on the opposite side of the "0" marking for indicating a progressive amount of rotation in the opposite direction (e.g. anticlockwise rotation—see FIG. 7C) about skew axis a2.

Whether or not there is any degree of relative rotation between the upper and lower portions of stand 10*a*, it readily will be discerned from FIG. 4 and the foregoing description that skew axis a2 substantially radially intersects both drum axis a1 and roller axis a3.

Skew Adjustment

From a practical point of view, it is desirable to provide a simple means to adjust the amount of rotation of upper portion 30 of stand 10*a* about skew axis a2, and to provide a simple means to secure the adjustment once it has been made. In this regard, stand 10*a* includes a rugged adjustment mechanism generally designated 50, and three locking bolts 58 the latter of which serve to secure a desired position of adjustment once it has been made.

Figure 6:
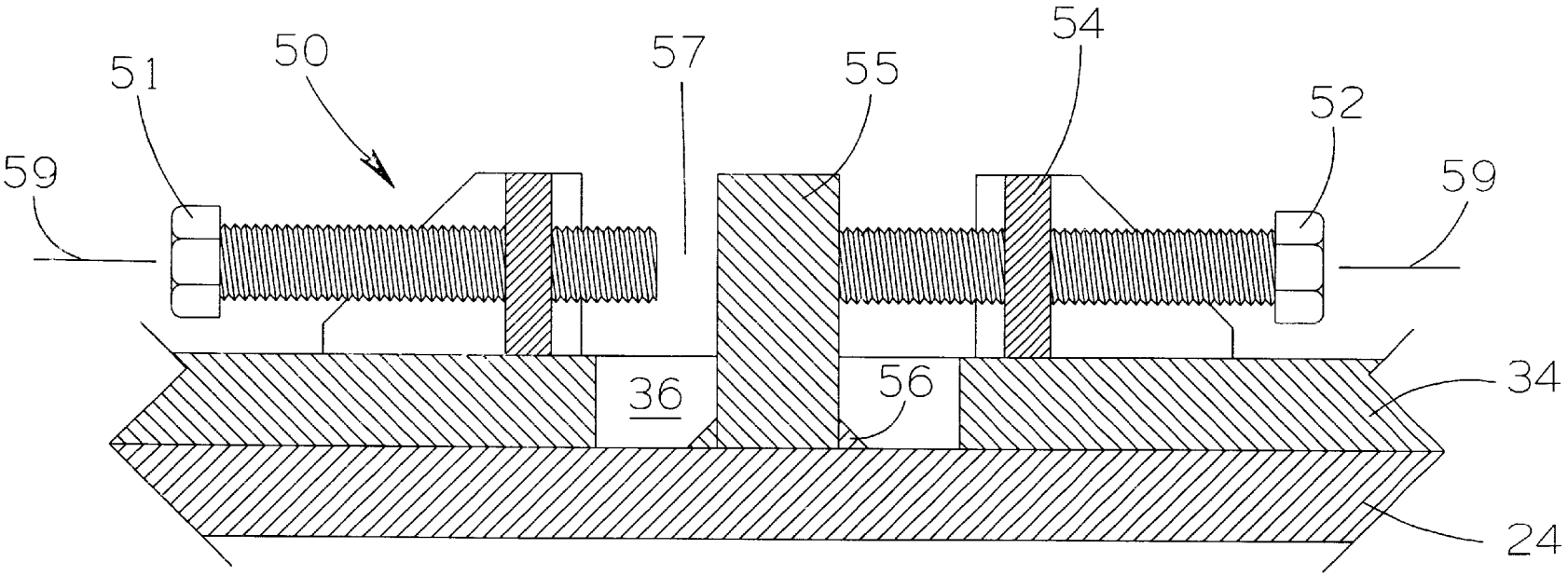
FIG. 6 is an enlarged detail section view of the adjustment mechanism shown in FIGS. 4 and 5.

Referring to FIGS. 4, 5 and 6, it will be seen that adjustment mechanism 50 comprises an opposed pair of adjustment bolts 51, 52 which are threaded through and carried by support brackets 53, 54 mounted on plate 34 of upper portion 30, and which extend on a common axis 59 tangentially (see FIG. 5) in relation to skew axis a2. Either adjustment bolt can be screwed through its support bracket without effect until its distal end begins to bear against a resistance block 55 which is mounted on plate 24 of lower portion 20 and extends upwardly through opening 36 in plate 34 of upper portion 30. Block 55 is secured to the upper surface of plate 24 by a strong filet weld 56.

Locking bolts 58 extend downwardly from upper portion 30 through elongated slots 38 in plate 34 to threadingly engage plate 24 of lower portion 20. When bolts 58 are loosened, upper portion 30 may be rotated relative to lower portion 20 about skew axis a2, the distance of travel being limited by the arc length of slots 38. When bolts 58 are tightened, plate 34 is drawn against plate 24 and the amount of rotation becomes fixed.

The operation of adjustment mechanism 50 will be readily apparent. To adjust the amount of rotation of upper portion 30 relative to lower portion 20, the first step is to loosen locking bolts 58 and to screw one of adjustment bolts 51, 52 sufficiently away from resistance block 55 to permit the desired amount rotational movement. Then, for example, if it was desired to rotate upper portion 30 anticlockwise in the view shown in FIG. 5, adjustment bolt 51 would be screwed away from block 55 as illustrated by gap 57 in FIG. 6. The other adjustment bolt (in this example, bolt 52) would then be screwed towards resistance block 55, ultimately to push with significant tangential force against the block. Since block 55 is affixed to lower portion 20, and since lower portion 20 is immovable, the result would be an equal and opposition reaction urging anticlockwise rotation. Finally, when the desired amount of anticlockwise rotation was achieved, locking bolts 58 would be retightened.

In the foregoing example, it should be noted that the amount of screwing torque required on bolt 52 typically will be substantial because the portion of the weight of drum 300 carried by stand 10*a* typically will be substantial. However, the required torque of course is mitigated by the presence of grease or other lubricant at the abutment interface between plates 24, 34 (see above).

Installation and Operational Alignment

Whether installed on a frame such as frame 200 or on some other platform, the positioning of stands 10*a*, 10*b*, 10*c*,

10*d* with respect to each other should be as indicated in FIGS. 2 and 3. As shown in FIG. 2, the stands are aligned such that fixed points 32 where the skew axes of the stands intersect the planes of tilt of the stands are aligned to define the four corners of a rectangle. Parallel lines s1, s2 and parallel lines s3, s4 represent the sides of the rectangle that is so defined.

As shown in FIG. 3, opposed stands 10*a*, 10*c* are positioned such that fixed points 32 are at the base of a triangle. The base of the triangle has a length corresponding to s1. The apex of the triangle is on drum axis a1. Skew axis a2 of stand 10*a* coincides with and leads on one side of the triangle from fixed point 32 of stand 10*a* to drum axis a1. Skew axis a2' of stand 10*c* coincides with and leads on the opposed side of the triangle from fixed point 32 of stand 10*c* to drum axis a1. Although not shown explicitly, opposed stands 10*b*, 10*d* satisfy the same criteria mutatis mutandis.

In FIG. 3, the angle between skew axes a2 and a2' is indicated as angle β. Preferably, angle β is about 60 degrees. This provides a broad base of support for drum 300 while avoiding undue lateral forces from the weight of drum tending to separate stands 10*a*, 10*c*.

In FIG. 2, each stand 10*a*, 10*b*, 10*c*, 10*d* is shown with zero degrees of relative rotation between the upper portion of the stand and the lower portion of the stand. Hence, the axis of roller 60 of stand 10*a* aligns with the axis of roller 60 of stand 10*b* along line s5. Likewise, the axis of roller 60 of stand 10*c* aligns with the axis of roller 60 of stand 10*d* along line s6. When stands 10*a*–10*d* are first installed this normally will be the initial alignment between the roller axes. Indeed, the alignment of the roller axes on lines s5, s6 rather than the alignment of fixed points 32 on lines s3, s4 can be used as one of the criteria for overall proper alignment. In either case, the result will be substantially the same. But, if the alignment is achieved using the roller axes as the criteria, then it is important to ensure that there is no relative rotation between the upper and lower portions of the support stands during the alignment procedure.

Figure 8A:
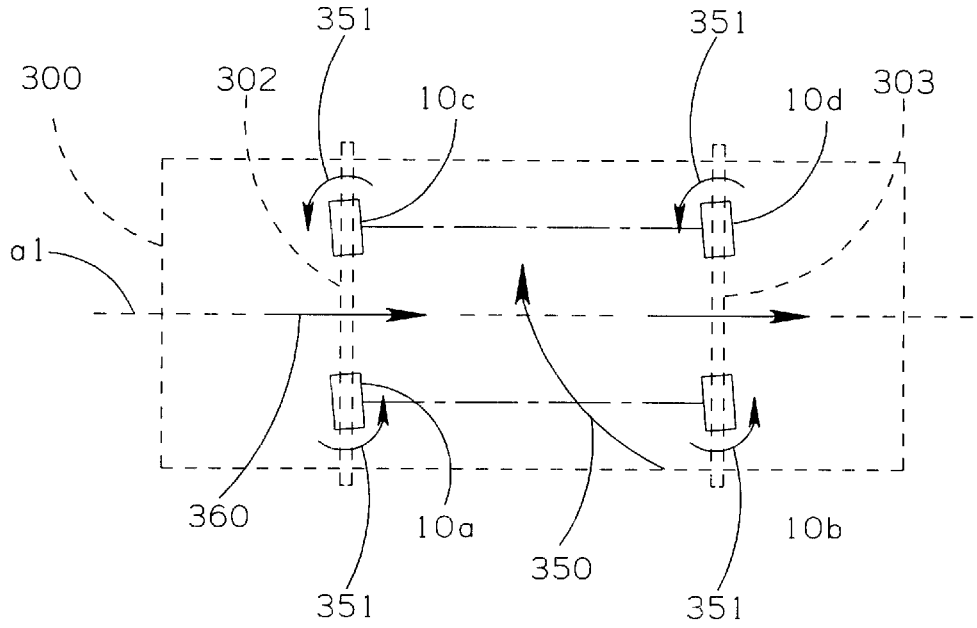
FIGS. 8A and 8B are representational views showing the tending direction of linear movement of a rotary drum as a function of its direction of rotation and the skew orientation of supporting rollers.
Figure 8B:
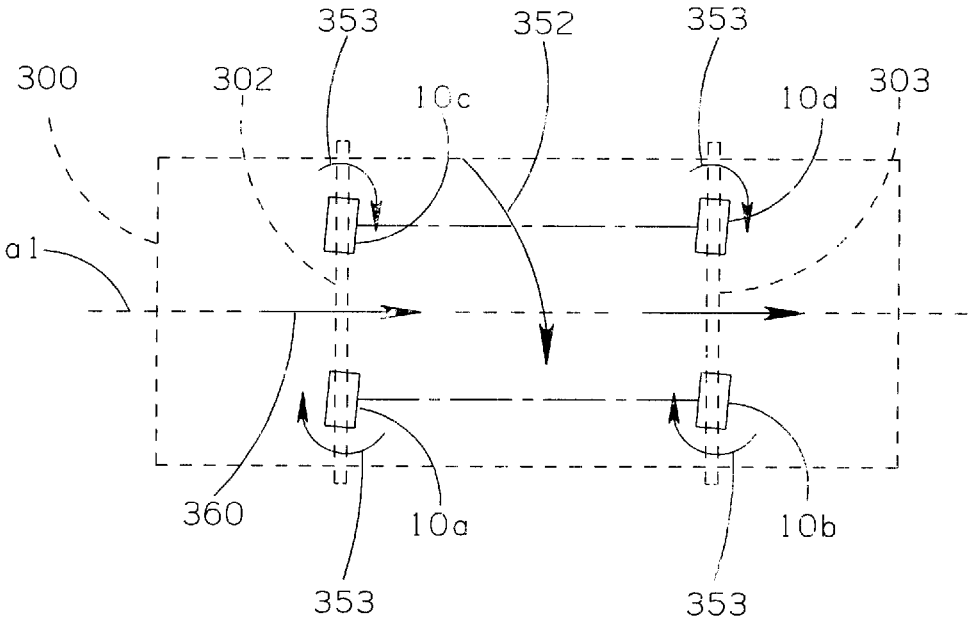

For reasons indicated in the above background discussion, and again well understood by those skilled in the art, a fully squared alignment as shown in FIG. 2 will not suffice for normal operations unless the tendency of drum 300 to move axially downhill is fully resisted by a thrust roller. In the present case, and although not shown, plant 200 includes a conventional thrust roller to bear against riding ring 302 in a conventional manner. But, as is commonplace, it is not designed to fully resist the thrust that drum 300 and its load may impart. Accordingly, it is necessary for rollers 60 of stands 10*a*, 10*c* to be skewed with respect to riding ring 302 and for the rollers 60 of stands 10*b*, 10*d* to be skewed by the same amount in relation to riding ring 303. If it is taken that drum 300 is rotating in the direction indicated by arrow 350 in FIG. 8A (looking representationally towards the tops of the rollers), then rollers 10*a*–10*d* are all skewed anticlockwise by a small amount as indicated by arrows 351 in FIG. 8A. Alternatively, if it is taken that drum 300 is rotating in the direction indicated by arrow 352 in FIG. 8B, then rollers 10*a*–10*d* are all skewed clockwise by a small amount as indicated by arrows 353. The necessary direction of skew will be readily apparent to those skilled in the art. In any case, the effect of the skew should be to urge drum 300 unhill (viz. from left to right along axis a1 in FIG. 1) as indicated by arrows 360 in FIGS. 8A, 8B.

The actual amount of required skew will depend on various factors well understood by those skilled in the art and common in the design of rotary drum installations. Obviously the angle α is an important factor. However, since the overall engineering can be very complex, on site testing mitigated by experience is not an uncommon approach. If the angle α is relatively small, the amount of skew will be correpondingly small.

In operation, the amount of skew for any given roller 60 should be substantially the same as for all other rollers 60. This should be the result following initial installation of stands 10*a*, 10*b*, 10*c*, 10*d* and adjustment of the stands' rollers on their associated skew axes, and it should be the result following any subsequent readjustments that may be made due to changing operating conditions. Workers are able to efficiently make such adjustments with stands 10*a*, 10*b*, 10*c*, 10*d* because the only allowed movement is rotational movement of upper portions 30 of the stands on their respective skew axes, and the amount of such rotation is precisely indicated by measuring scale 90 on each of the stands. Translational movements cannot occur without moving the stands themselves. Thus, misalignments between the stands cannot be introduced by the actions of workers who merely are making skew adjustments.

Variations

A variety of modifications, changes and variations to the invention are possible within the spirit and scope of the following claims, and will undoubtedly occur to those skilled in the art. The invention should not be considered as restricted to the specific embodiment that has been described and illustrated with reference to the drawings.

What is claimed is:

1. A support stand for supporting an elongated rotary drum for rotation about a longitudinally extending drum axis, said drum including a riding ring extending coaxially around the drum for receiving such support, said stand comprising:

(a) a lower portion extending upwardly from a base to a tilted top extending in a plane of tilt;

(b) a correspondingly tilted upper portion mounted atop said lower portion, said upper portion being rotatably positionable relative to said lower portion about a skew axis perpendicularly intersecting said plane of tilt at a fixed point; and, (c) a carrying roller rotatably mounted on said upper portion for rotation about a roller axis while said ring bears against and rides in rolling contact on said roller with said skew axis substantially radially intersecting said drum axis, said skew axis substantially radially intersecting said roller axis.

2. A support stand as defined in claim 1, said stand further including an indicator for displaying the amount of rotation of said upper portion of the stand relative to said lower portion of the stand about said skew axis.

3. A support stand as defined in claim 1, wherein said upper portion is constrained to rotate relative to said lower portion about said skew axis by a center pin extending from said lower portion to said upper portion, said center pin having a center pin axis coinciding with said skew axis.

4. A support stand as defined in claim 3, said stand further including an indicator for displaying the amount of rotation of said upper portion of the stand relative to said lower portion of the stand about said skew axis.

5. A support stand as defined in claim 4, wherein said indicator comprises a measuring scale visibly marked on a first one of said portions and a pointer carried by the second one of said portions, said pointer being directed towards said scale for displaying said amount of rotation.

6. A support stand as defined in claim 5, wherein said scale includes:

(a) a center marking for indicating no relative amount of rotation between said upper and lower portions about said skew axis;

(b) a first series of markings on a first side of said center marking for indicating a progressive amount of clockwise rotation of said upper portion relative to said lower portion about said skew axis; and, (c) a second series of markings on a second side of said center marking for indicating a progressive amount of anticlockwise rotation of said upper portion relative to said lower portion about said skew axis.

7. A support stand as defined in claim 6, wherein said measuring scale is marked on said lower portion of said stand.

8. A support stand as defined in claim 1, further including an adjustment mechanism, said adjustment mechanism comprising:

(a) a resistance block mounted to said lower portion; and, (b) an opposed pair adjustment bolts aligned on a common axis, each threadingly engaged with an associated support bracket mounted to said upper portion, said common axis extending tangentially in relation to said skew axis, said resistance block extending upwardly between said bolts, each of said bolts being screwable within its associated support bracket to bear against said resistance block and thereby urge rotation of said upper portion of said stand relative to said lower portion of said stand about said skew axis.

9. A support stand as defined in claim 8, including locking bolts for releasably securing the position of rotation of said upper portion relative to said lower portion; each bolt extending through an associated elongated slot in said upper portion and threadingly engaging said lower portion.

10. In combination with an elongated rotary drum rotatable about a longitudinally extending drum axis, said drum including first and second longitudinally spaced riding rings extending coaxially around the drum:

(a) a first pair of stands associated with said first riding ring for providing support to said drum from opposed sides of said first riding ring; and, (b) a second pair of stands associated with said second riding ring for providing support to said drum from opposed sides of said second riding ring;

each of said stands comprising:

(i) a lower portion extending upwardly from a base to a tilted top lying in a plane of tilt;

(ii) a correspondingly tilted upper portion rotatably mounted atop said lower portion, said upper portion being rotatably positionable relative to said lower portion about a skew axis perpendicularly intersecting said plane of tilt at a fixed point; and, (iii) a carrying roller rotatably mounted on said upper portion for rotation about a roller axis, the said one of said riding rings associated with said stand bearing against and riding in rolling contact on said roller, said skew axis substantially radially intersecting both said roller axis and said drum axis.

11. A combination as defined in claim 10, each of said stands further including an associated indicator for displaying the amount of rotation of said upper portion of the stand relative to said lower portion of the stand about said skew axis of the stand.

12. A support stand as defined in claim 10, wherein for each stand said upper portion is constrained to rotate relative to said lower portion about said skew axis by a center pin extending from said lower portion to said upper portion, said center pin having a center pin axis coinciding with said skew axis.

13. A support stand as defined in claim 12, said stand further including an indicator for displaying the amount of rotation of said upper portion of the stand relative to said lower portion of the stand about said skew axis.

14. A combination as defined in claim 13, wherein each said indicator comprises a measuring scale visibly marked on a first one of said portions of the associated stand, and a pointer carried by the second one of said portions of the associated stand, said pointer being directed towards said scale for displaying said amount of rotation.

15. A combination as defined in claim 14, wherein for each said indicator said scale includes:

(a) a center marking for indicating no relative rotation between said upper and lower portions of the associated stand about said skew axis;

(b) a first series of markings on a first side of said center marking for indicating a progressive degree of clockwise rotation of said upper portion of the associated stand relative to said lower portion of the associated stand about said skew axis; and, (c) a second series of markings on a second side of said center marking for indicating a progressive degree of anticlockwise rotation of said upper portion of the associated stand relative to said lower portion of the associated stand about said skew axis.

16. A combination as defined in claim 15, wherein each said measuring scale is marked on said lower portion of the associated stand.

17. A method of providing roller support for an elongated rotary drum rotatable about a longitudinally extending drum axis, said drum including first and second longitudinally spaced riding rings extending coaxially around the drum, said method comprising:

(a) for each riding ring, providing a pair of stands for supporting said drum from opposed sides of the ring, each of said stands comprising:

(i) a lower portion extending upwardly from a base to a tilted top lying in a plane of tilt;

(ii) a correspondingly tilted upper portion rotatably mounted atop said lower portion, said upper portion being rotatably positionable relative to said lower portion about a skew axis perpendicularly intersecting said plane of tilt at a fixed point;

(iii) a carrying roller rotatably mounted on said upper portion for rotation about a roller axis, the said one of said riding rings associated with said stand bearing against and riding in rolling contact on said roller, said skew axis substantially radially intersecting both said roller axis and said drum axis; and, (iv) an indicator for indicating the amount of rotation of said upper portion relative to said lower portion about said skew axis from an initial datum, (b) rotating the said upper portion of each of said stands about its associated skew axis to a position such that the said indicated amount of rotation relative to its said lower portion is the same as for all said stands.

18. A method as defined in claim 17, further including the preliminary step of aligning said stands with said drum such that:

(a) said fixed points define the four corners of a rectangle;

(b) the roller axis of a first one of said rollers is axially aligned with the roller axis of a second one of said rollers, and extends parallel to said drum axis; and, (c) the roller axis of a third one of said rollers is axially aligned with the roller axis of a fourth one of said rollers, and extends parallel to said drum axis, the resulting position of each of said stands then defining the initial datum for each of said stands.

* * * * *

UNITED STATES PATENT AND TRADEMARK OFFICE

CERTIFICATE OF CORRECTION

PATENT NO. : 6,447,289 B1 
DATED : September 10, 2002
INVENTOR(S) : Jeffery Franklin Boyne and Donavan Roy Larsen It is certified that error appears in the above-identified patent and that said Letters Patent is hereby corrected as shown below:

Title page,
Item [56], References Cited, add the following documents to the list of documents under U.S. PATENT DOCUMENTS:

| | | | |
|---|---|---|---|
| -- 2,722,408 A | 11/1955 | Hilkemeier | 366/63 |
| 4,129,036 A | 12/1978 | Bliemeister | 73/140 |
| 4,624,576 A | 11/1986 | Dillman | 366/63 |
| 4,496,116 A | 9/1987 | Livingston | 34/108 |
| 5,462,370 A | 10/1995 | Kastingschafer et al. | 384/549 --. |

Add a new sub-heading reading:
-- FOREIGN PATENT DOCUMENTS --.

FOREIGN PATENT DOUMENTS, list the following document:
-- WO 98/46952 10/1998 --.

Signed and Sealed this

Fourth Day of February, 2003

JAMES E. ROGAN
*Director of the United States Patent and Trademark Office*